US011383120B2

(12) United States Patent
Cone

(10) Patent No.: US 11,383,120 B2
(45) Date of Patent: Jul. 12, 2022

(54) PHYSICAL THERAPY AND FITNESS DEVICE

(71) Applicant: Elly Frymire Cone, River Forest, IL (US)

(72) Inventor: Elly Frymire Cone, River Forest, IL (US)

( * ) Notice: Subject to any disclaimer, the term of this patent is extended or adjusted under 35 U.S.C. 154(b) by 38 days.

(21) Appl. No.: 16/995,193

(22) Filed: Aug. 17, 2020

(65) Prior Publication Data

US 2021/0170216 A1 Jun. 10, 2021

Related U.S. Application Data

(63) Continuation-in-part of application No. 16/708,070, filed on Dec. 9, 2019, now Pat. No. 11,167,173.

(51) Int. Cl.
*A63B 21/055* (2006.01)
*A63B 21/00* (2006.01)

(52) U.S. Cl.
CPC .... *A63B 21/0557* (2013.01); *A63B 21/00043* (2013.01); *A63B 21/0555* (2013.01); *A63B 21/4035* (2015.10)

(58) Field of Classification Search
CPC ..... A63B 21/4013; A63B 21/4015
See application file for complete search history.

(56) References Cited

U.S. PATENT DOCUMENTS 2,829,891 A * 4/1958 Ludwig ..... A63B 22/16 482/146
4,273,327 A * 6/1981 Nall ..... A63B 21/0004 482/146
5,261,866 A * 11/1993 Mattox ..... A63B 21/0552 482/125
5,529,562 A * 6/1996 Glaser ..... A63B 21/154 482/123
6,203,476 B1 * 3/2001 Wang ..... A63B 21/0552 482/121
6,361,516 B1 * 3/2002 Hamel ..... A61F 5/0111 128/882
6,425,844 B1 * 7/2002 Azar ..... A61H 1/0259 482/123
6,629,913 B2 * 10/2003 Chen ..... A63B 21/0004 482/121
D482,748 S * 11/2003 Flynt ..... D21/662
7,387,599 B1 * 6/2008 Hsu ..... A61H 15/0092 482/122
7,591,763 B1 * 9/2009 Fucci ..... A63B 21/0552 482/121
7,946,970 B2 * 5/2011 Garza, Jr. ..... A63B 71/0036 482/126
8,142,336 B1 * 3/2012 Yates ..... A63B 23/0405 482/124
9,011,295 B2 * 4/2015 Orenstein ..... A63B 23/0458 482/52

(Continued)

*Primary Examiner* — Nyca T Nguyen
(74) *Attorney, Agent, or Firm* — Michael P. Mazza; Michael P. Mazza, LLC

(57) ABSTRACT

A physical therapy and fitness device which includes one or more balance pedals slidahle along one or more resistance bands. Handles may be used with the resistance bands, and the balance pedals may include an elongated slot through which the band(s) slide. Each balance pedal may include opposing projecting raised ledges to facilitate bolding a foot in place during use of the device.

21 Claims, 17 Drawing Sheets

(56) References Cited

U.S. PATENT DOCUMENTS 9,962,574 B2 * 5/2018 Sperry ..... A63B 23/04
D910,124 S * 2/2021 Jaquish ..... D21/673
11,167,173 B2 * 11/2021 Cone ..... A63B 21/00043
2002/0198081 A1 * 12/2002 Chen ..... A63B 21/00043 482/23
2005/0020418 A1 * 1/2005 Lin ..... A63B 23/0458 482/142
2005/0107226 A1 * 5/2005 Monda ..... A63B 21/04 482/121
2006/0189459 A1 * 8/2006 Hsu ..... A63B 23/03525 482/125
2007/0015644 A1 * 1/2007 Aucamp ..... A63B 21/154 482/130
2008/0293550 A1 * 11/2008 Campbell ..... A63B 26/00 482/121
2010/0255966 A1 * 10/2010 Aucamp ..... A63B 21/0552 482/131
2011/0312477 A1 * 12/2011 Wiseman ..... A63B 21/0552 482/126
2013/0178346 A1 * 7/2013 Lin ..... A63B 22/16 482/146
2013/0239440 A1 * 9/2013 Santos ..... A63B 21/4033 36/136
2015/0190679 A1 * 7/2015 Carbone ..... A63B 21/0004 482/146
2015/0342297 A1 * 12/2015 Garza, Jr. ..... A63B 23/1209 482/122
2016/0171904 A1 * 6/2016 Almarales ..... A63B 26/003 434/250
2016/0206920 A1 * 7/2016 Gillis ..... A63B 21/0414
2016/0339296 A1 * 11/2016 Barel ..... A63B 21/4034
2017/0043211 A1 * 2/2017 Mack ..... A63B 21/0428
2017/0157467 A1 * 6/2017 Strong Crawley .. A63B 26/003
2018/0290008 A1 * 10/2018 Avila ..... A63B 21/0004
2020/0086173 A1 * 3/2020 Marti ..... A63B 21/4043
2021/0170216 A1 * 6/2021 Frymire Cone ... A63B 21/0557

* cited by examiner

PHYSICAL THERAPY AND FITNESS DEVICE

This application is a continuation-in-part of parent application U.S. Ser. No. 16/708,070, filed Dec. 9, 2019; where possible, any disclosure in this application, whether express or inherent, claims the priority of this parent filing date. A video in DVD format (see https://getbalanceband.com/how-it-works/) is attached as an Appendix to this application, illustrating the use of the present invention to provide fundamental balance and strengthening benefits. This video is also incorporated by reference into this patent application.

BACKGROUND OF THE INVENTION

The present invention generally relates to physical therapy and/or general fitness devices utilizing resistance bands.

Balance is foundational to any and all age groups, whether athletes or not. From a baby learning to walk and gaining their balance, to the gifted athlete or seniors, all can benefit from improved balance. Statistically, falls account for the death every 20 minutes of an older person in the United States. 76% of these falls are lateral or sideways falls, according to the Center for Disease Control. Falls are the top cause of fatal injuries in older adults, and many falls are preventable. One-third of adults aged 65 or older fall each year, while 95% of all hip fractures are caused by falling. Fallers typically have less muscular strength in their lower extremities than non-fallers, according to the American Council on Exercise (On et al. 2008). Falling one time doubles your chance of falling again. Falls presently cost our U.S. health care system over $50 billion annually. Current demographics show an acceleration in the elderly population, which is the group most at risk of falls, with attendant health care costs only increasing.

Optimizing balance and fall prevention requires strengthening the foot and leg muscles, including the hip flexors, hip extensors, hip abductors, knee flexors, knee extensors, ankle dorsiflexors and ankle plantar flexors. Strengthening these leg muscles results in a statistically significant improvement in balance (Journal of Physical Therapy Science 26: 1771-1774, 2014). However, seniors often struggle with balance, as they lose muscle mass with advancing age, while also becoming more afraid of a fall as they age.

Resistance bands have been used to optimize balance and increase leg strength. However, while these bands are excellent tools, they can be dangerous. First, they can easily slip out from under the users' foot and snap up and hit the exerciser. Second, standing on an exercise band is not recommended as the wear and tear from shoes onto the tubing can cause the tubing or band to fray, weaken and break. Accordingly, it would be advantageous to provide a physical therapy and fitness device that enhances balance and strengthens leg muscles, while avoiding these problems encountered with resistance bands.

SUMMARY OF THE INVENTION

The objects mentioned above, as well as other objects, are solved by the present invention, which overcomes disadvantages of prior physical fitness devices using resistance bands, while providing new advantages not previously associated with them.

In a preferred embodiment, a physical therapy and fitness device is provided which may, but need not, include a pair of handles, each graspable by a user's hand, and one or more balance pedals (preferably a pair), adapted to removably support a user's foot of the user. In the particularly preferred embodiment, the balance pedal(s) are slidable along one or more resistance bands attached, directly or indirectly, to the handles. The bands may be elastic or inelastic, but are preferably elastic.

In one preferred embodiment, the balance pedal(s) stay connected to the user's feet due at least in part to upward forces generated by the user's hands acting upwardly on the band(s) and therefore the pedal(s), and not because it is necessary to tie in or otherwise attach the user's feet to the pedals.

The balance pedal(s) may include an aperture or cavity through which the band(s) pass, thereby permitting the balance pedal to be slidable relative to the band(s) when a lateral force is exerted on the pedal by a user's foot. Preferably, the aperture or cavity is adapted for relatively frictionless sliding contact between the aperture or cavity and the band(s) passing through it.

In one preferred embodiment, a top surface of the balance pedal(s) may include opposing projecting lips or ledges, to facilitate holding a user's foot in place during use of the device. In another embodiment, the distance between the projecting lips may be adjusted. Top and/or bottom surfaces of each balance pedal may also include frictional grooves adapted to provide a gripping action between the top surface of each balance pedal and a user's foot, and between the bottom surface of each balance pedal and the ground.

Preferably, the length of the pedal(s) is less than the length of a user's foot, thereby enabling the foot to rock back-and-forth relative to the pedal during use of the device, further enhancing the stability exercise.

In yet another preferred embodiment, the bands may color-coded to denote different lengths for seating or standing use and/or differing resistances.

In an alternative embodiment of the present invention, the physical therapy and fitness device may include only one or more balance pedals, adapted to removably support a foot of the user during use of the device. The one or more balance pedals may be slidable along one or more resistance bands. As an example, two balance pedals may be slidable along a single resistance band. Also, one or a pair of graspable handles may be connected or attached to the one or more resistance bands and may, but need not, be used.

The balance pedal(s) may each include an elongated slot running longitudinally along a bottom surface of the balance pedal, and adapted to receive the resistance band, thereby permitting the resistance band to be slidable within the elongated slot of the balance pedal when a lateral force is exerted on the pedal by a foot of a user of the device. In one preferred embodiment, the elongated slot is ovoid in cross-sectional shape, and may have smooth outer edges providing relatively frictionless sliding contact between the slot and the resistance band passing through it.

Preferably, the balance pedals remain in contact with a user's foot due at least in part to upward forces generated by the user's hands acting upwardly on the one or more bands and the one or more pedals, and not due to tying in or otherwise attaching the user's feet to the pedals.

In a preferred embodiment, a top surface of each balance pedal includes opposing projecting raised ledges which facilitate holding a foot of a user of the device in place during use of the device. In one embodiment, the distance between the raised ledges may be adjusted.

A top surface of each balance pedal may include frictional grooves or pads adapted to provide a gripping action between the top surface of each balance pedal and a user's foot. Alternatively, or in addition, a bottom surface of each balance pedal may include frictional grooves or pads adapted to provide a gripping action between the bottom surface of each balance pedal and the ground.

In one embodiment, a top surface of the balance pedal has a convex curvature in cross-section, sized to accommodate a foot of a user of the device. Further, opposing ends of the elongated slot, or a longitudinal trough, may be tapered to facilitate guiding of the resistance bands into the elongated slot. Preferably, the width of the elongated slot is less than the untensioned diameter of the resistance band, to keep the band in place within the balance pedal's slot.

Preferably, the elongated slot is positioned at or closely adjacent to a center-of-mass location of the pedal.

As an example, a preferred embodiment of the balance pedal can support up to about 1,000 pounds before failing.

The balance pedals may be made of materials including ABS, polycarbonate, or a blend of each. Each balance pedal may have a lattice structure and is relatively lightweight, at about or less than 6 ounces each.

In an alternative embodiment, no break in the bottom surface of the balance pedal exists, so no elongated slot or longitudinal trough is formed. This will provide an even stronger version of the balance pedal.

DEFINITION OF CLAIM TERMS

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

"Balance pedal" means a foot support, slidable along a resistance band. Each balance pedal may but need not be connected by a resistance band to a handle.

"Resistance band" means a band, rope or cord, including but not limited to physical fitness devices commonly known as "resistance bands" or "resistance cords" or "fitness bands" or "fitness cords." (The "resistance band" need not be elastic or stretchable; as a non-limiting example, a nylon band is included within the term "resistance band" here.)

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 1:
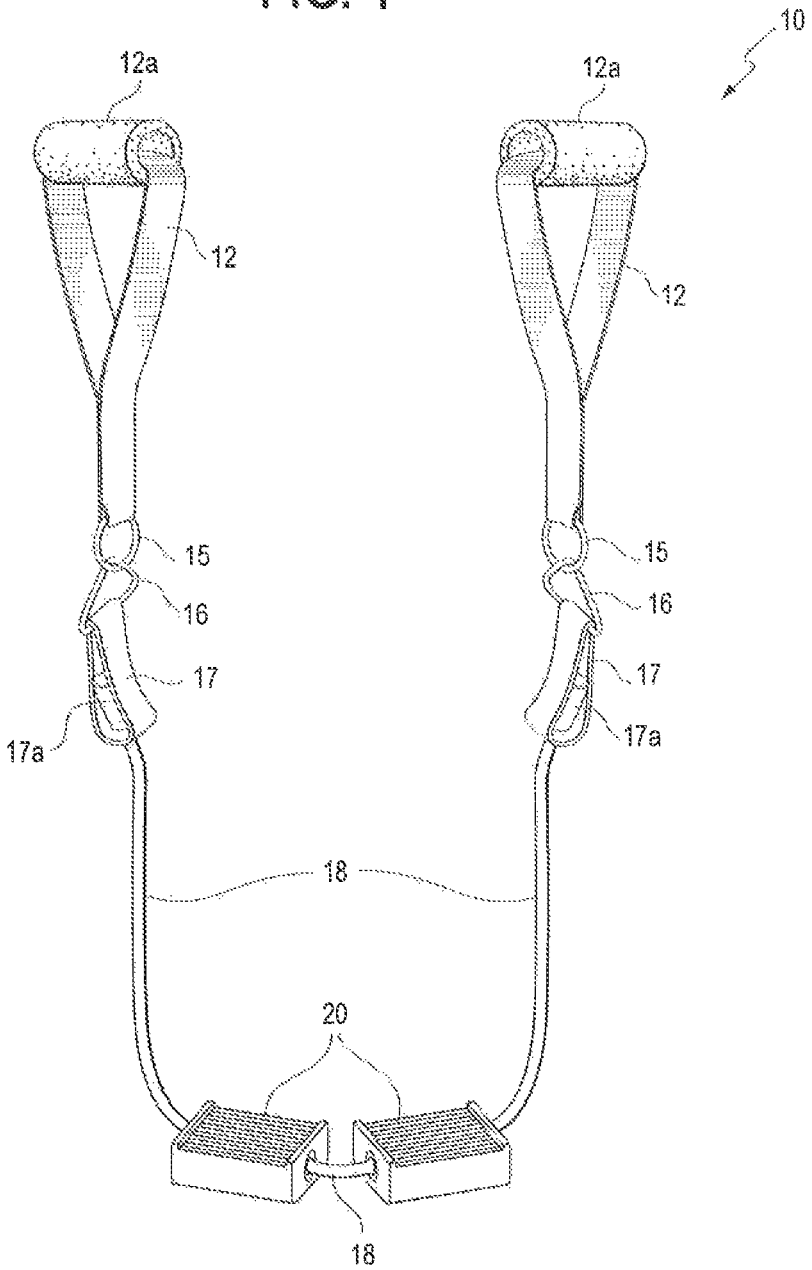
FIG. 1 is a perspective view of a preferred embodiment of a physical fitness device according to the present invention.
Figure 2:
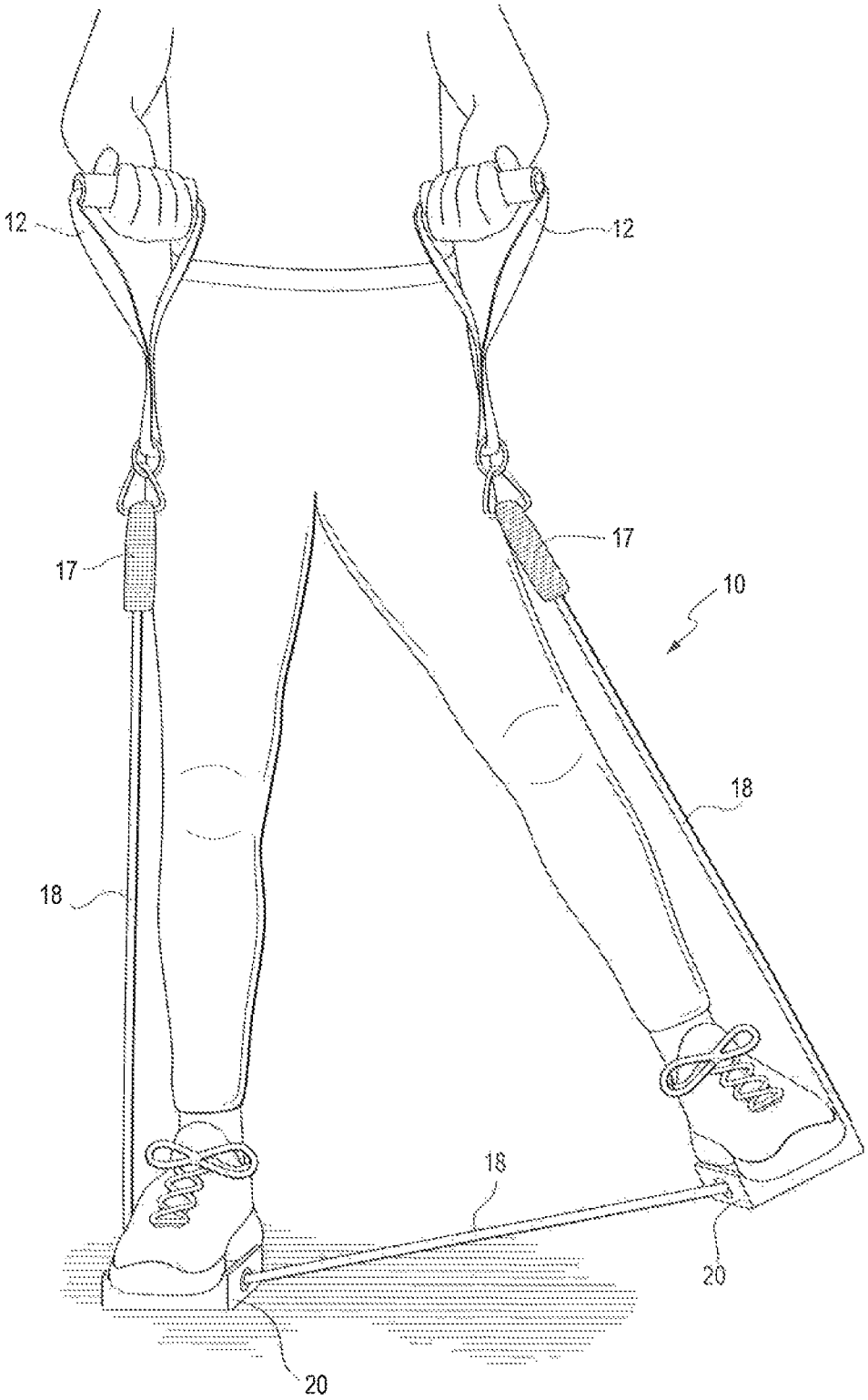
FIGS. 2-3 are views similar to FIG. 1 showing the device in use.
Figure 3:
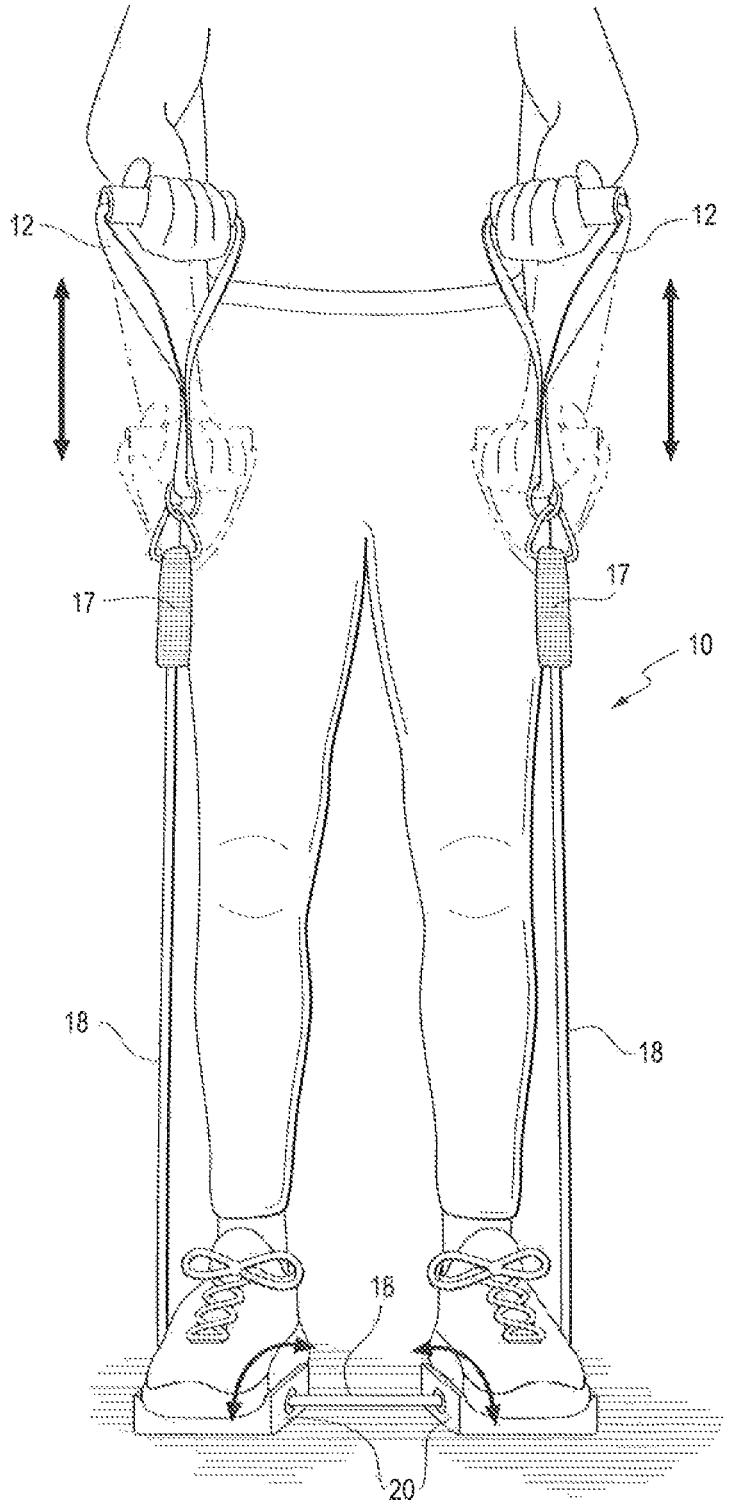
Figure 5:
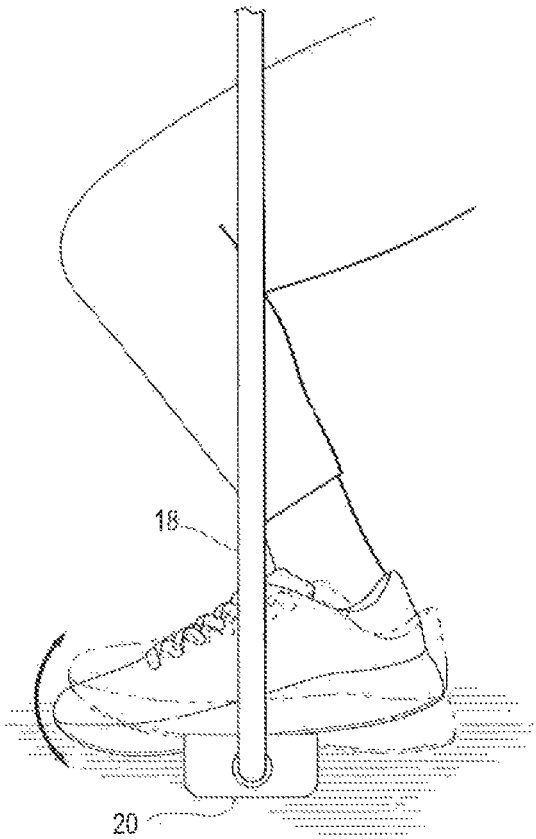

Referring first to FIGS. 1-3, a preferred embodiment of the physical therapy and fitness device, known as the BalanceBand™, of the present invention is shown, designated generally by the reference numeral 10. BalanceBand™ 10 may include a pair of padded handles 12*a* attached by a (e.g., nylon) strap or cord 12 to a metal ring 15, which is attached to a metal carabiner 16, which is in turn attached to a nylon strap 17 (e.g., 4-inches in length). Nylon strap 17 may be attached to an elastic cord or band 18 (e.g., seated version length may be 23-inches, while standing version may be 40-inches) and fastened using plugs 17*a*. Opposing ends of resistance cord or band 18 may each pass through a pedal aperture 21 (see FIG. 5) of a pair of balance pedals 20.

Figure 6:
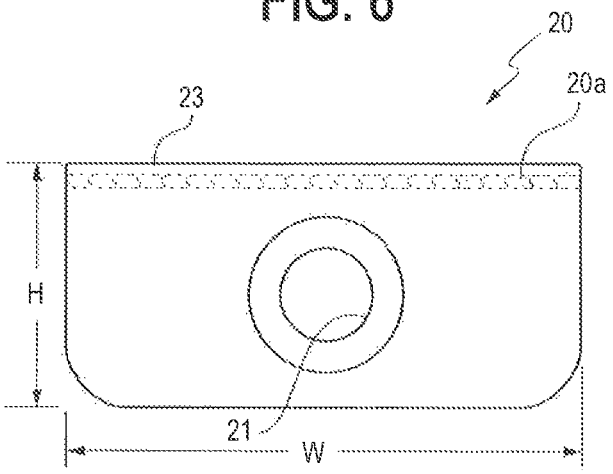
FIGS. 6-7 are enlarged side and perspective views of a pedal of the device.

Referring to FIG. 6, aperture or cavity 21 may be about ¾-inch in diameter, and may be smooth-lined (e.g., with nylon edging) to limit friction and allow balance pedals 20 to slide smoothly along cord/band 18 through pedal apertures 21. The material surrounding apertures or cavities 21 may be splayed, outwardly flaring and beveled to further limit friction between them and the elastic cord/band 18. In an alternative embodiment, rather than running through the pedal, the cavity or aperture may be positioned adjacent a top or bottom surface of the pedal, although it is preferred to locate the cavity or aperture through or closely adjacent to a center-of-mass location of the pedal.

Figure 7:
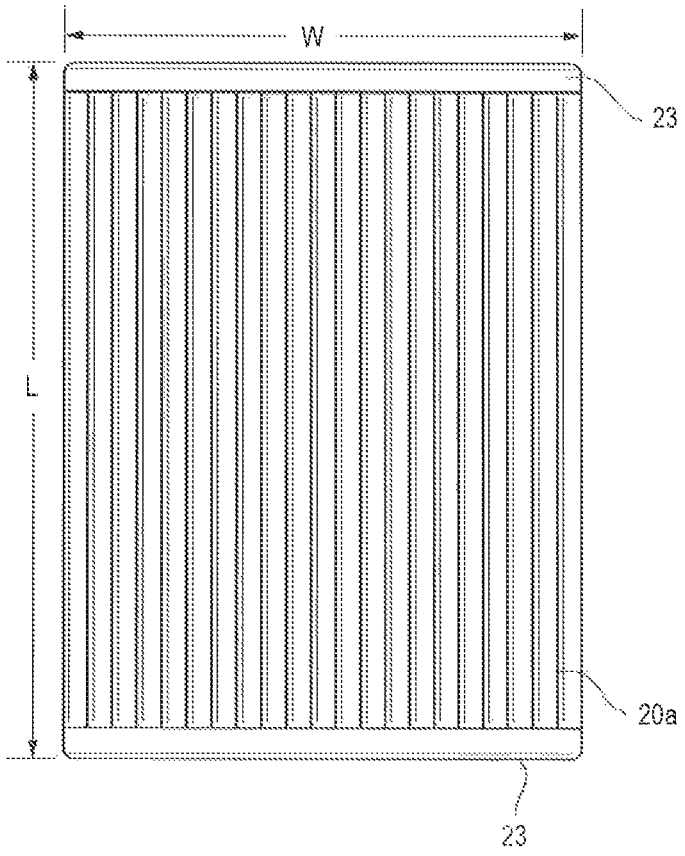

Referring to FIGS. 6-7, balance pedal may be, e.g., about 1-inch in height H, about 3-inches in width W and about 4-inches in length L. The pedal platform is relatively wide for efficient weight distribution. The top surface 20*a* may include rubberized or embossed grip patterns 22 for enhanced gripping between the pedal and a foot, and may also include opposing lips 23 (e.g., as shown in FIG. 6, ¼-inch height and ⅛-inch wide) or raised ledges 23 (e.g., as shown in FIGS. 10-17, ¾-inch height, ¼-inch wide) positioned at edges of the pedal to assist in holding a foot laterally in place on the pedal. The pedal is preferably designed so that the "Up" side presents itself via gravity.

While FIG. 1 shows the currently-preferred embodiment, persons of ordinary skill will recognize variations may be made from this embodiment, within the scope of the claims. For example, while in the preferred embodiment elastic cord/band 18 is one smooth, integral piece attached to nylon straps 17, elastic cord/band 18 may instead consist of a non-elastic (e.g., nylon) strap or band running from nylon strap 17 until a position upstream of but relatively adjacent each pedal 20, and may thereafter consist of an elastic band/cord. Even the band/cord length associated with and passing through the pedals may be non-elastic, for a given use/preference/user. (User preference, depending upon the user's need and the exercise, may dictate different embodiments in this regard.)

In another embodiment, multiple (two or more) resistance bands may be connected or attached to each pedal 20, providing the user with more tensioning and strength-building options.

Additionally, while elements 15, 16 and 17/17*a* are provided in the preferred embodiment, in another embodiment handle 12 may simply be attached via a strap or otherwise directly to cord/band 18. In yet another embodiment, handles need not be used at all, and a continuous loop-type resistance band may be used. Still other attachment and connection elements and mechanisms will be understood to those of ordinary skill in the art.

Various other types of handles and/or connectors for the resistance bands may be used with the present invention. As non-limiting examples, the following handles may also be used: adjustable Escalade Sports Lifeline (single band and multi-band); Fitness Insanity resistance bands (stackable, 5-piece exercise bands); and Theraband resistance band handles. Continuous loop resistance bands (without a handle) may also be used with the balance pedals of the present invention, such as ChampionPlus Pull Up Assist Bands, or Yes4All Power Bands (exercise resistance loop bands). In fact, any type of resistance band, including rubber or elastic bands or cords, or nylon straps, may be connected directly to the balance pedals without using a handle, and the band itself can be held by the exercise user.

The BalanceBand™ has been found to overcome problems associated with resistance bands used alone. The unique design, with the elastic tubing running through relatively frictionless apertures in the pedal, keeps the tubing healthy and safe. The wide design of balance pedal 20 distributes the user's weight evenly and avoids the possibility of slipping. Further, a beginner to the BalanceBand™ may use it while seated in a chair, providing enhanced safety. Virtually all of the exercises using the BalanceBand™ can be performed seated or standing.

Balance pedal 20 allows the user to place a foot securely on the pedal, which distributes the weight evenly on the pedal, which is very different—and much safer—than when a user steps directly on an exercise band. Further, the pedal's unique design, in which the elastic band, cord or tubing runs directly through the pedal's (e.g.) nylon-lined cavity or aperture provides a relatively frictionless connection with the pedals, which maintains the health and integrity of the resistance band, providing it with a longer useful life.

Three exercises in particular have been found to best strengthen the necessary leg muscle groups required to optimize balance: lateral side stepping, glute kickbacks, and lateral leg lifts:

A) Lateral Side Stepping: this movement strengthens the lateral (outside) leg abductor muscles, as well as the tops of feet and the lateral hips.

B) Glute Kick Backs: this movement strengthens the back of the legs as well as the buttocks.

C) Lateral Leg Lift: this movement one strengthens the lateral hip abductors (outside hip).

Figure 4:
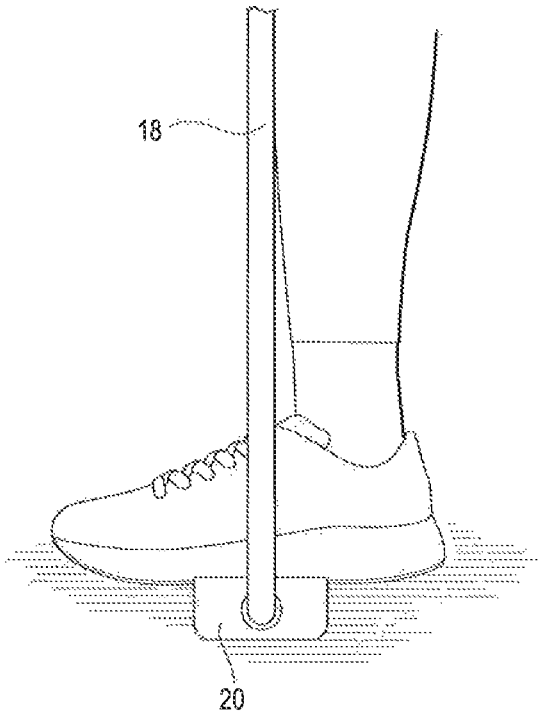
FIGS. 4-5 are partial side perspective views of a lower portion of the device in use.

A person of ordinary skill will recognize that each of these exercises can be performed using physical fitness device 10 of the present invention. The BalanceBand™ is unique in the manner in which it allows a user to strategically pinpoint these muscles important to balance, and to perform the movements as described above. Further, the pedal design with the ledges is designed to position the user's foot in an optimum position to properly target these muscles for optimal balance muscle strengthening. In addition to the general overall strengthening of lower extremity muscles through the use of the present invention, the pedals also provide an additional benefit: as the foot is not fully supported, but rather is permitted to rock back and forth on the pedal, these perturbations or disturbances require the user to continuously seek to regain stability, which further enhances balance. Thus, referring to FIGS. 4-5, pedal 20 allows the foot to pivot back-and-forth (front-to-back as shown by the arrow on FIG. 5). Put another way, the user's foot placement on the pedals inherently creates balance instability, causing the body to react and regain balance, which further enhances overall stability. Pedals 20 thus enable a user to accurately, effectively and evenly distribute their weight on each pedal by allowing foot placement in an optimal position to effectively achieve the desired balance strengthening benefits.

Referring to FIG. 7, in yet another alternative embodiment, the distance between opposing lips 23 may be adjusted (in any number of ways, using pins, ratchets or other mechanisms) to adjust for individual foot width, enabling a snugger placement of the foot on a pedal. The top surface of pedals 20 may be flat/planar (as shown in FIGS. 1-8, for example), or alternatively may be slightly convex as shown in FIG. 9; however, for safety, the foot should not be tied in or affixed to the pedal in any type of manner that is not immediately removable from the pedal.

Figure 8:
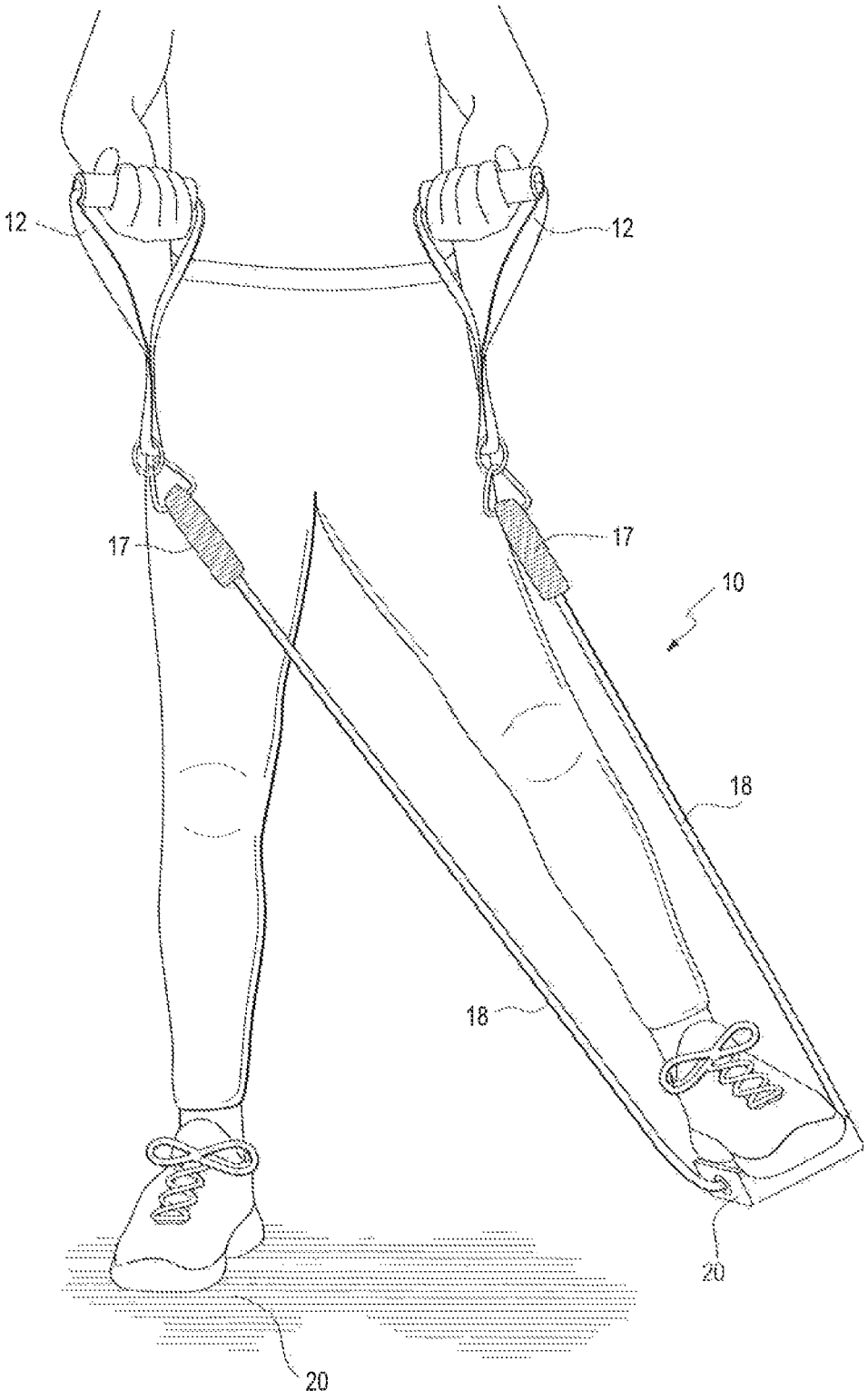
FIG. 8 is a view similar to FIG. 1 showing a one-pedal device in use.
Figure 9:
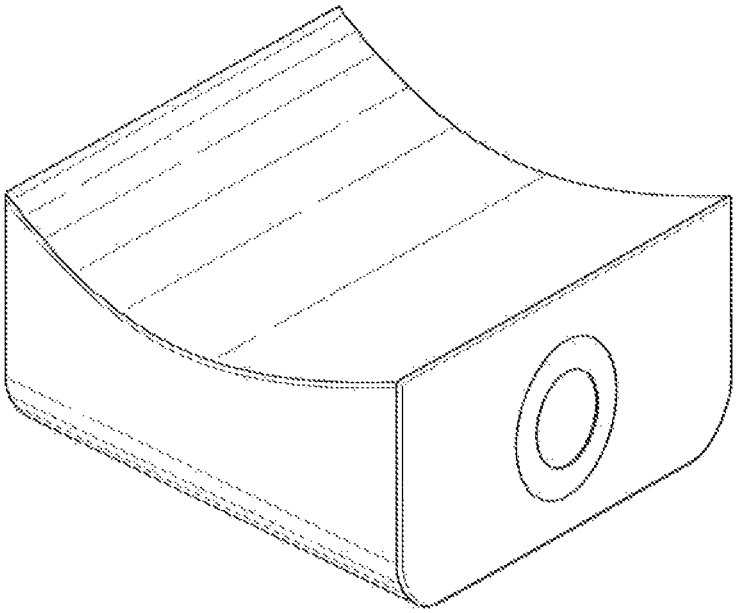
FIG. 9 is an enlarged side and front perspective view of an alternative embodiment of a pedal useful in the present invention.

In an alternative embodiment, shown in FIG. 8, only one pedal need be used. Standing on the ground while lifting the pedal-secured foot can be done, as shown in FIG. 8. Alternatively, utilizing the "wobble board" effect, and for an even greater degree of difficulty, the user can stand on the pedal (which is lying on the ground) and then lift, with control, the non-pedal-secured foot (not shown). These single-limb exercises are excellent for balance and strength, and can prove to be more difficult to use than the dual-pedal device.

The BalanceBand™ enables users to exercise from their own home, while improving your balance at a very low cost. It has great flexibility, too, as the youngest athlete can use it to improve their game, while the oldest adult can use it to strengthen their legs and reduce the risk of falling. Further, because balance pedals 20 can be slid up and down the band, they can be moved to the side, or they can be removed completely, and the elastic band can be used for a number of additional exercises, such as triceps strengthening. Triceps are considered a "go-go" muscle by the exercise community, as they are needed to push ourselves up to get out of a chair. (If a user can't get out of a chair, he/she is house-bound, equating to a loss of independence). The BalanceBand™ also enables users to perform triceps extensions, further empowering users and allowing them to maintain their independence.

Different elastic bands or cords may be color-coordinated to facilitate use. For example, yellow (e.g., 23-inches in length) may be used for seated balance/strength work. Other colors for bands/cords may be used for standing work (e.g., 40-inches in length), with different colors denoting different band/cord thicknesses (and thus differing resistances) selected for the level of the user (e.g., green for beginners, red for intermediate users, and blue for advanced users). Each colored band/cord is preferably interchangeable with the comfort grip handle system.

In a less preferred embodiment, the pedal(s) could be affixed to the band(s), so that the pedal(s) do not slide along the band(s). With this embodiment, the band(s)' width could be widened or thickened in the area adjacent the pedal(s), to strengthen the band(s)/pedal(s) connection.

Figure 10:
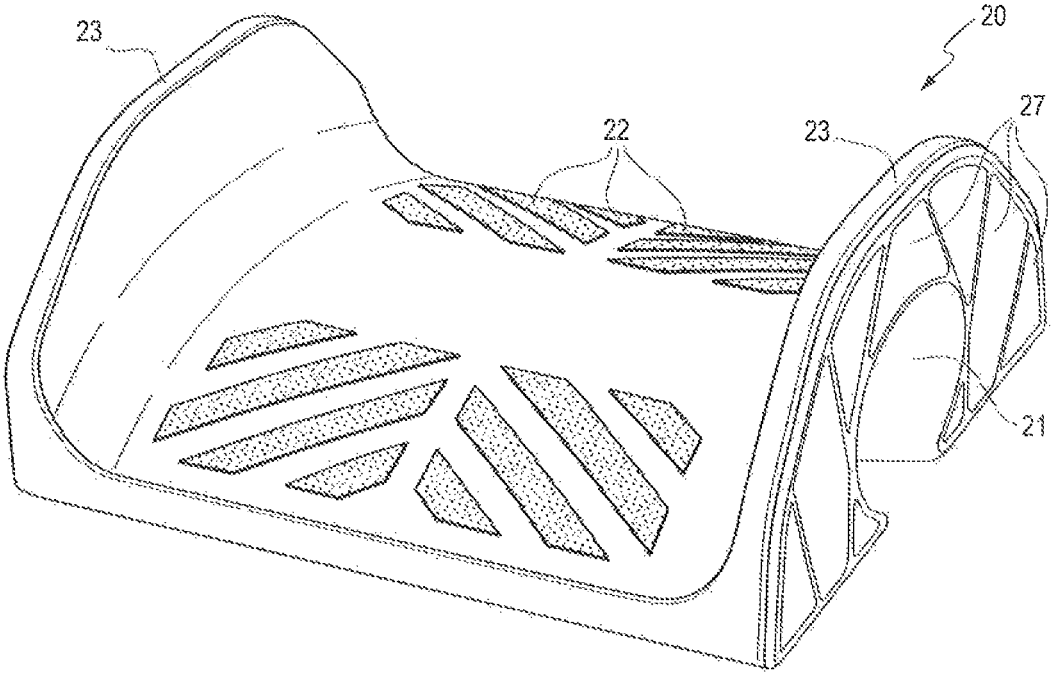
FIG. 10 is an enlarged planar perspective view of yet another embodiment of the balance pedal of the present invention.
Figure 11:
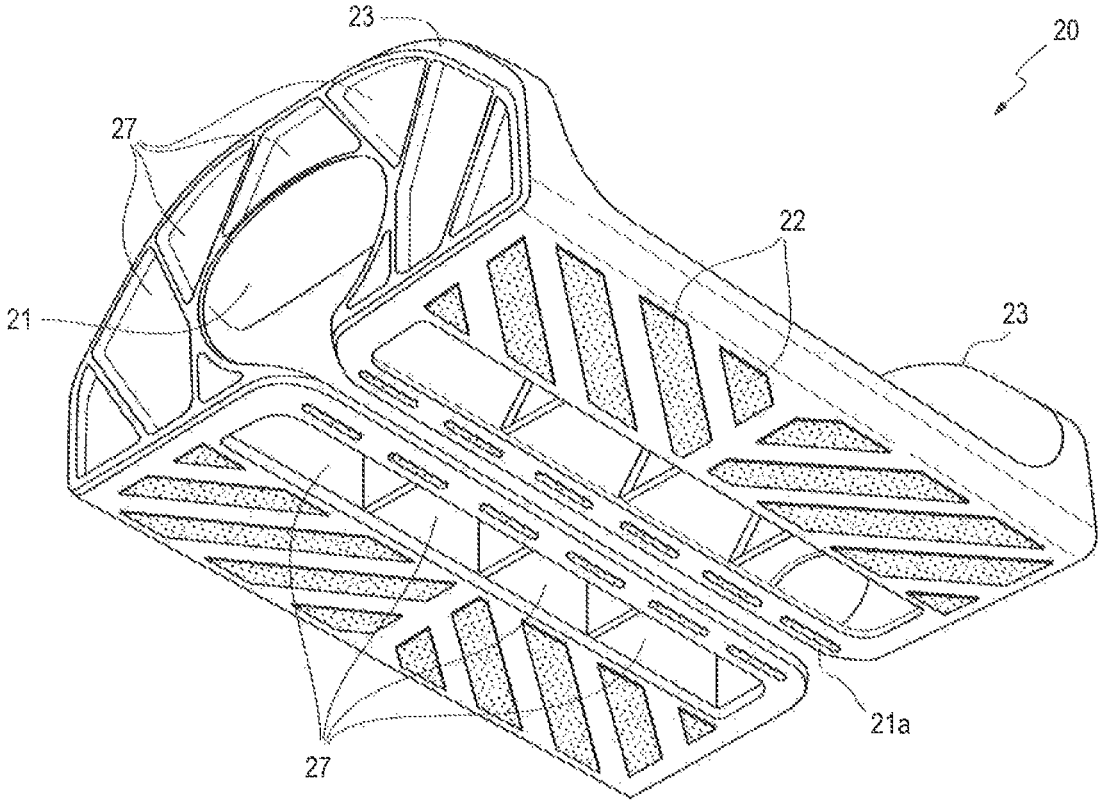
FIG. 11 is a bottom and side perspective view of the pedal shown in FIG. 10.
Figure 12:
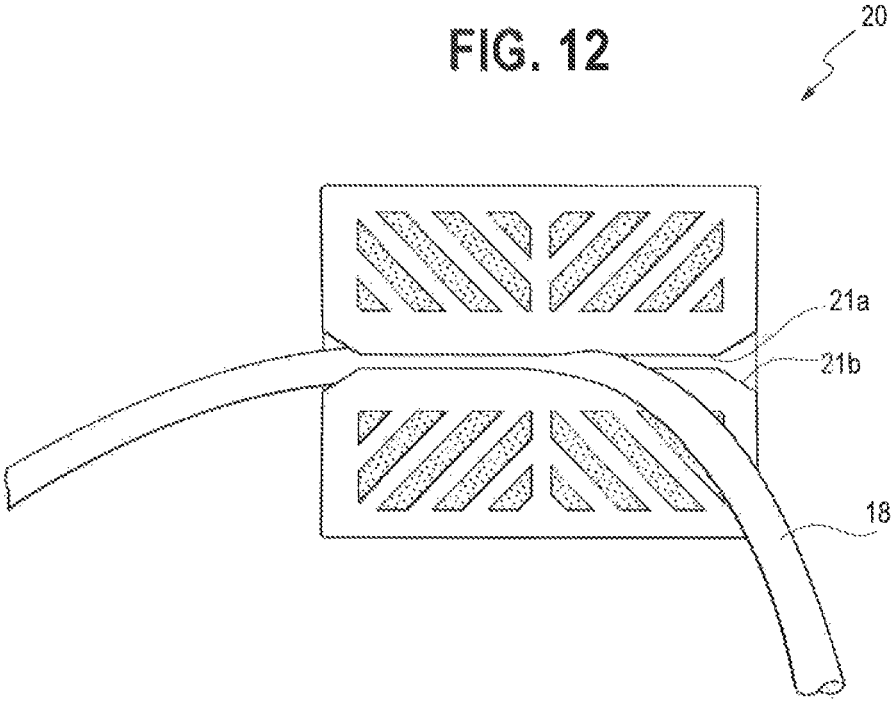
FIGS. 12-13 are bottom perspective views of the pedal shown in FIG. 10.
Figure 13:
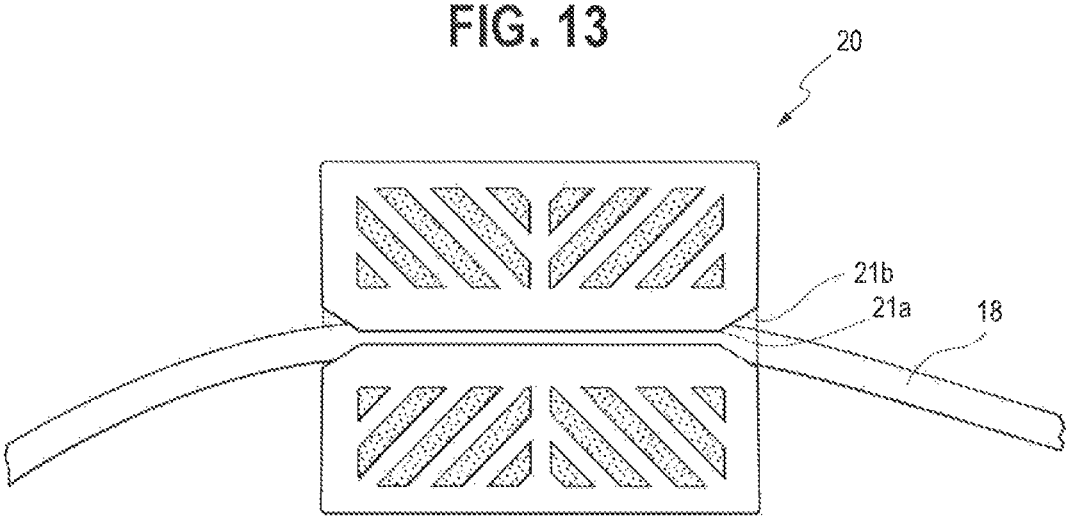
Figure 14:
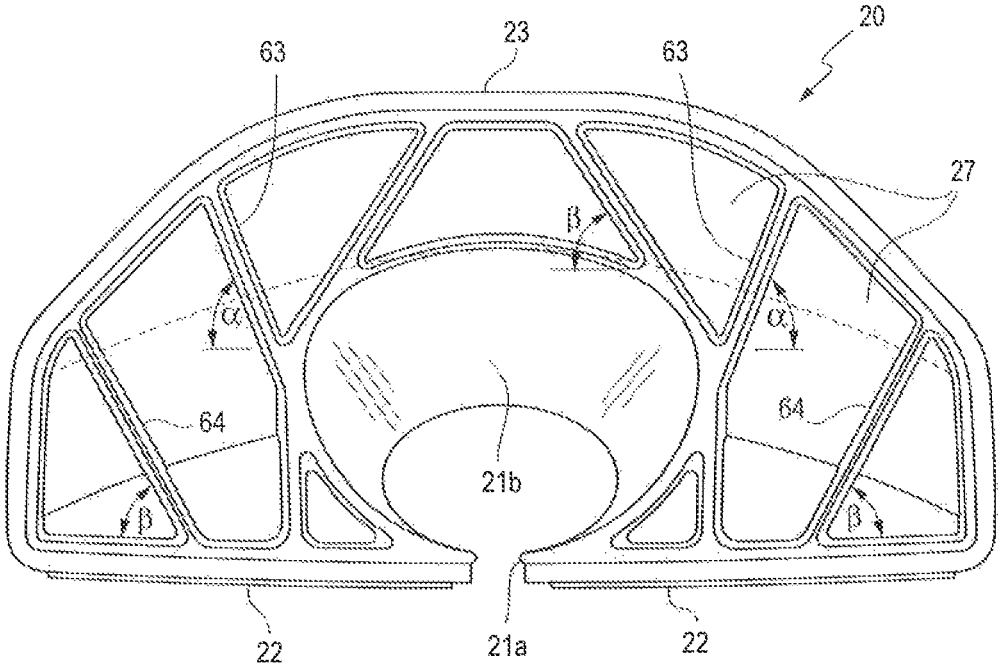
FIG. 14 is a side cross-sectional view of the pedal shown in FIG. 10.
Figure 15:
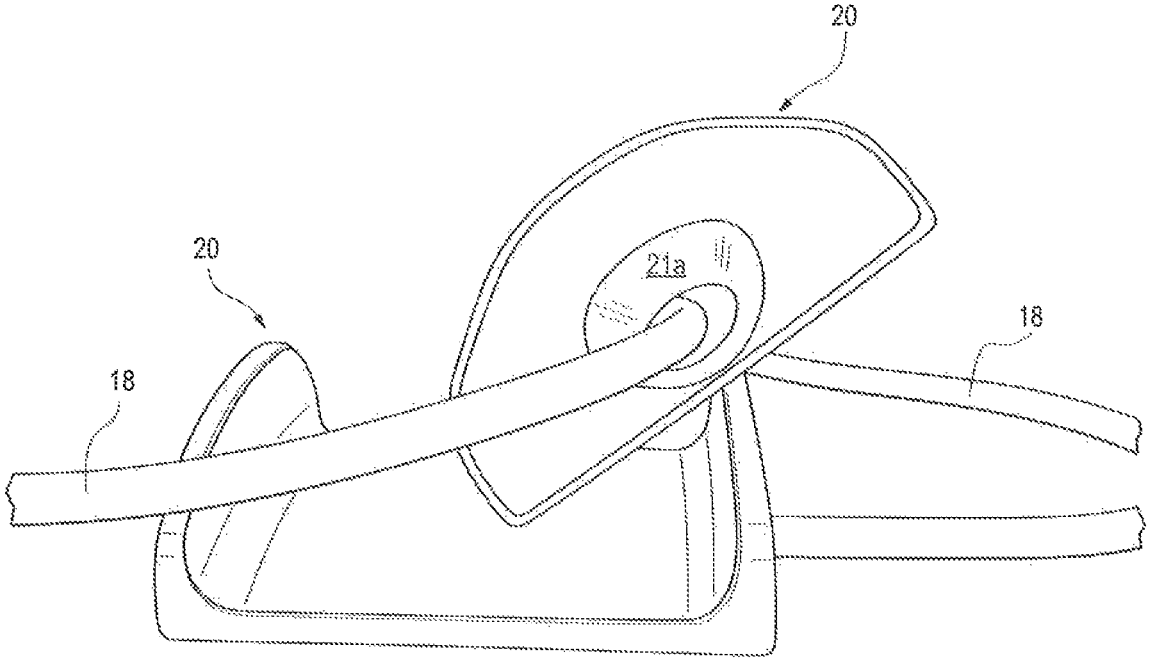
FIG. 15 is a perspective view of pedals of the FIG. 10 embodiment, with inserted resistance bands.
Figure 16:
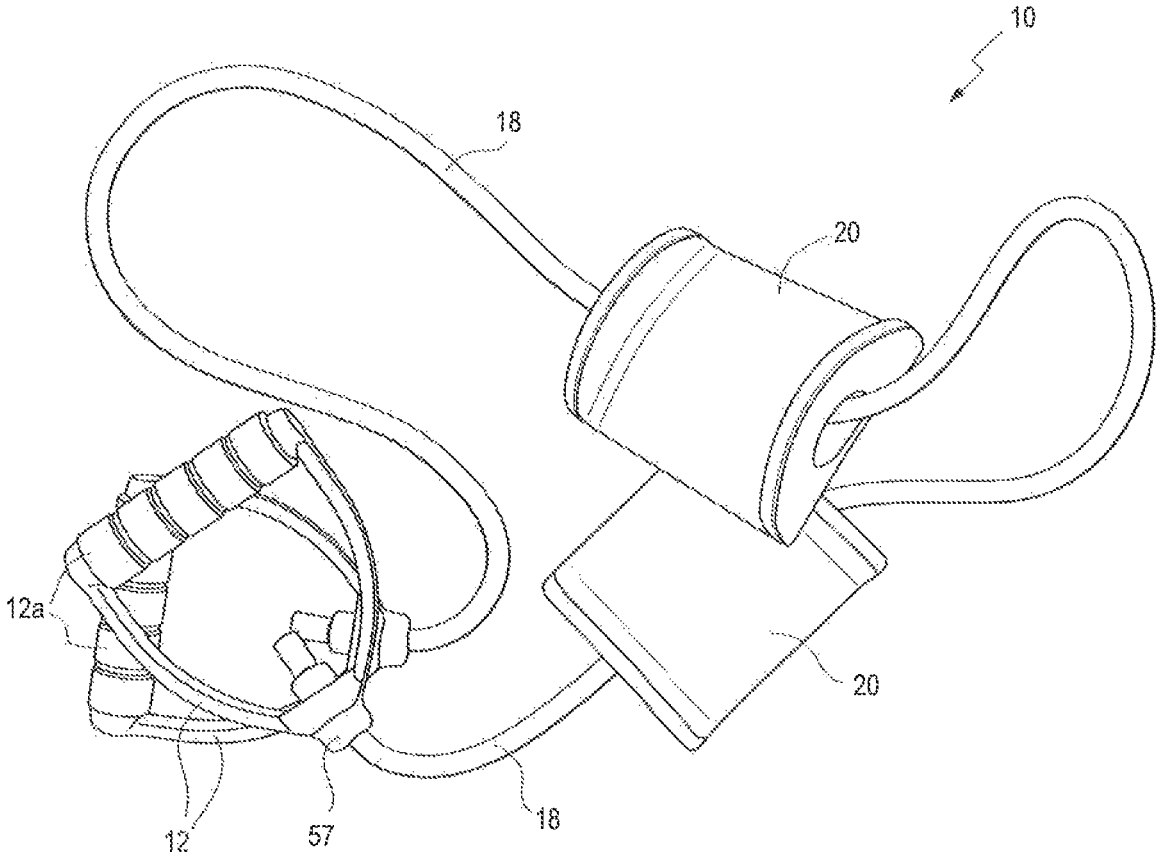
FIG. 16 is a perspective view of a complete system (handles, bands, pedals) according to one embodiment of the present invention, using the FIG. 10-embodiment pedals.
Figure 17:
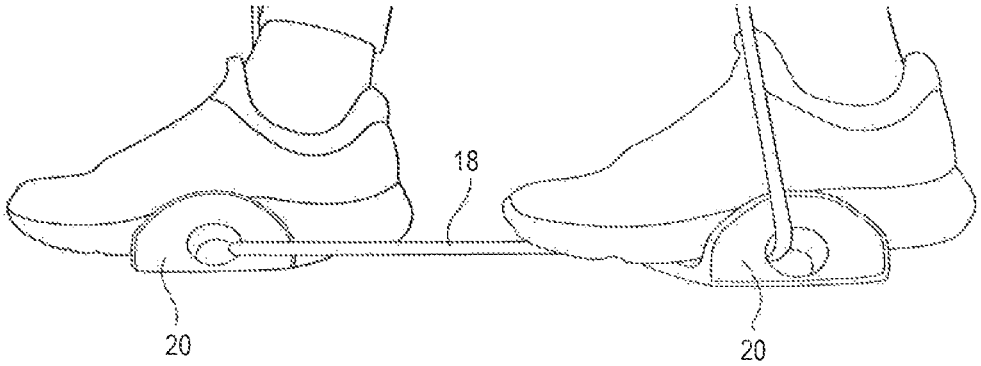
FIG. 17 is a side perspective view showing use of the FIG. 10-embodiment pedals.

In yet another alternative embodiment, shown in FIGS. 10-19, balance pedal 20 may be sold separately from the resistance band. As with previous embodiments, a break in the bottom surface of the pedal may be provided, forming an open trough 21*a* (FIG. 12) which transforms into elongated opening 21. The band may then be crimped, stretched and/or elongated so that it is pushed through trough 21*a* and falls into the corresponding slot 21 in the pedal, as shown in FIGS. 12-13, so that once the band is entirely within the slot, it is slidably moveable within the slot. Slot 21 preferably enlarges to an elongated ovoid-shaped slot with curved surfaces 21*b*, as shown in FIG. 14 (approximate ellipse with approximate foci of 1" and 0.6"). Preferably, opposing ends 58 of the elongated slot are splayed at opposed ends 21*b*, as shown (FIGS. 12-14), to ensure smooth, relatively frictionless movement of the band through the pedal as the resistance band enters or exits the slot. This slot configuration has proven to be useful in preventing the resistance band from crimping as the band slides through the slot during exercise. Additionally, given that a user can be at various positions when exercising, the ovoid shape also allows for a smooth transition for the band no matter what angle it exits from the slot ends.

Referring to FIG. 10, in a preferred embodiment the balance pedal has an upper surface curvature which slightly narrows towards the middle, mimicking the human foot's natural curves. This allows for optimum foot placement and positioning on the pedal, holding the foot gently but always allowing for quick step out.

Rubberized grooves 22 may be provided on the upper surface of the pedal (FIG. 10) to prevent the foot from slipping relative to the pedal. Rubberized grooves may also be provided on the underside of the pedal (FIG. 11) to prevent the pedal from slipping relative to the ground.

The balance pedals offer wide, safe and stable foot placement. This reduces the risk of dangerous snapping or breaking of bands that can occur with direct foot placement on traditional exercise bands. The raised side ledges on the balance pedals allow for secure foot placement, while permitting quick and safe step-out.

The balance pedals may be manufactured using a 3-D printing process. Alternatively, for mass manufacturing, an injection molding process may be used.

As shown in FIGS. 10-11 and 14, a lattice structure that includes support ribs 63, 64 and deep grooves 27 in the side and bottom of the pedals provides a way to remove weight, while still providing strength, allowing each pedal to only weigh about 5-6 ounces. In a particularly preferred embodiment, the pedals may be made out of acrylonitrile butadiene styrene ("ABS," a common thermoplastic polymer), polycarbonate, or a blend of each. (The bottom of the pedal still provides good traction using rubberized treads, for example, which may have a design similar to the bottom of the tread on a running shoe.)

Referring now to FIG. 14, the balance pedals may be designed using a lattice structure with support ribs and grooves, so that they are strong yet lightweight. The upper surface of the balance pedal contacting the foot (the foot pad) is preferably slightly convex. In the preferred embodiment of FIG. 14, for example, angle Alpha is about 68° (i.e., columns 63 form a 68° angle with the horizontal) while angle Beta is about 62° (i.e., columns 64 form a 62° angle with the horizontal). This support structure is strong yet lightweight, able to hold up to about 1,000 pounds without failing/breaking. Given the relatively slight curvature of the convex foot pad of the balance pedal, use of the device is safe, as the user can place her/his toes or heel on the floor at any time. For a more difficult exercise, toes and heels may be lifted off the floor during exercise, providing a more enhanced balance challenge, which strengthens both the front shin muscles (tibialis anterior) as well as calf muscles.

Figure 18:
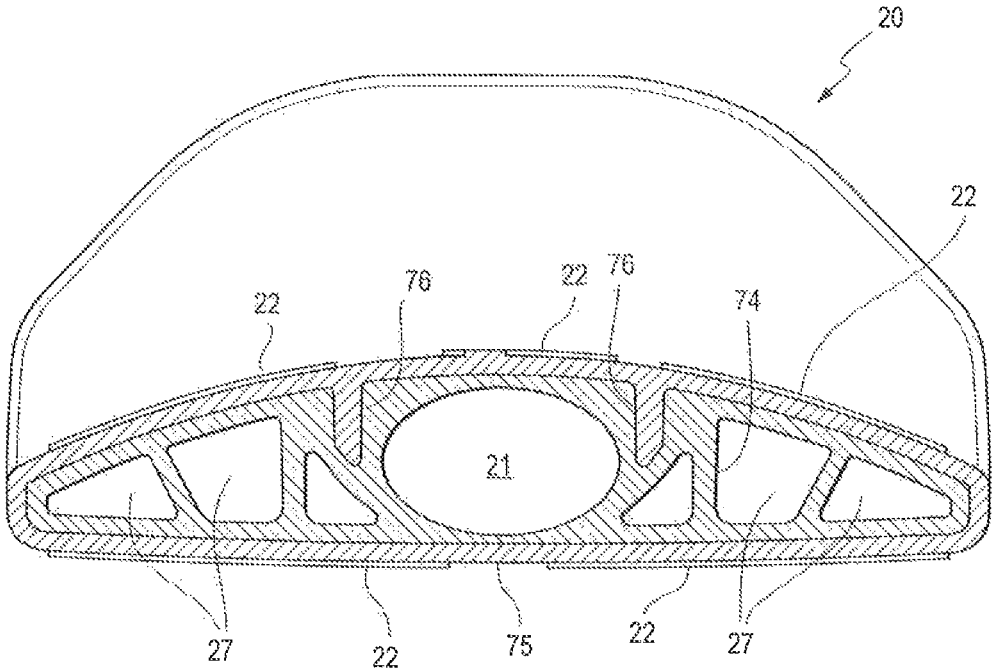
FIG. 18 is a side cross-sectional view of an alternative embodiment of a balance pedal of the present invention.

While it is currently preferred to crimp and elongate the band to pass through slot 21, FIG. 18 shows an alternative embodiment in which no opening exists at the bottom of the pedal. Instead, an inner lattice structure 74 is connected to an outer lattice structure 75, such as by using outer lattice connecting fingers 76 fitting within corresponding slots in the inner lattice structure. This embodiment is stronger than the FIG. 14 embodiment. With this embodiment, the resistance band (which may be flat or cylindrical in cross-section) may be threaded through the ovoid-shaped slot 21, from one opposing end to the other.

In yet another embodiment, not shown in the drawings, a lockable sliding door, for example, may be used to provide a temporary opening for band insertion, which may then be closed and locked.

Figure 19:
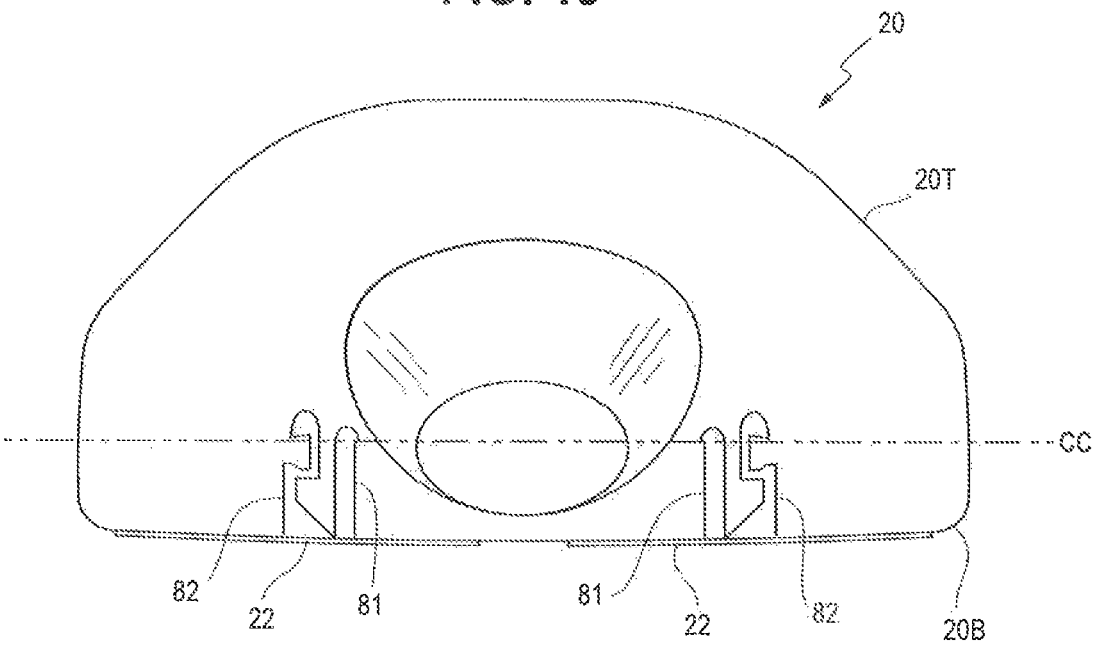
FIG. 19 is a side cross-sectional view of yet another embodiment of a balance pedal of the present invention.

FIG. 19 is yet another embodiment of an alternative design of the present invention. Here, an ovoid slot is also used, but the parts are simpler to manufacture; a top half 20T and a bottom half 20B are joined at line CC and may be snapped together or otherwise connected, and unbuckled or otherwise unfastened, such as using connecting members 81, 82, again allowing the balance pedal to be used with different exercise resistance bands (such as bands differing in resistance or color or both).

In summary, BalanceBand™ allows you to quickly and easily target and strengthen the exact muscles responsible for your balance: core, hips, legs, ankles, calves and feet. Exercising with the BalanceBand™ for minutes a day will retrain these muscles and will improve your posture, reduce back pain, and enhance performance. The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

I claim:

1. A physical therapy and fitness device, comprising:

one or more balance pedals, adapted to removably support a foot of a user during use of the device, wherein each of the one or more balance pedals includes an elongated slot running longitudinally through the balance pedal, the elongated slot receiving one or more resistance bands and having opposing ends tapered to facilitate guiding of the one or more resistance bands into the elongated slot, to thereby permit the one or more resistance bands to be slidable through the elongated slot, wherein a top surface of the one or more balance pedals has a convex curvature in cross-section sized to accommodate the foot of the user of the device, wherein during use of the device the user's foot pushes the one or more balance pedals so that the one or more balance pedals move and slide relative to the one or more resistance bands when a lateral force is exerted on the pedal by the foot of the user of the device, the one or more balance pedals thereby moving and sliding in a lateral direction generally perpendicular to a length of the foot while the user maintains resistance on the one or more resistance hands.

2. The physical therapy and fitness device of claim 1, wherein the elongated slot runs longitudinally along a bottom surace of the one or more balance pedals.

3. The physical therapy and fitness device of claim 2, wherein the elongated slot is ovoid in cross-sectional shape.

4. The physical therapy and fitness device of claim 2, wherein the elongated slot has smooth outer edges providing relatively frictionless sliding contact between the slot and the resistance band passing through the slot.

5. The physical therapy and fitness device of claim 2, wherein the elongated slot is positioned at or closely adjacent to a center-of-mass location of the one or more balance pedals.

6. The physical therapy and fitness device of claim 1, wherein the top surface of each balance pedal includes opposing projecting raised ledges which facilitate holding the foot of the user of the device in place during use of the device.

7. The physical therapy and fitness device of claim 6, wherein a distance between the opposing raised ledges of at least one of the one or more balance pedals is adjustable.

8. The physical therapy and fitness device of claim 1, further comprising handles graspable by the user and connected to the one or more resistance bands.

9. The physical therapy and fitness device of claim 1, wherein the one or more balance pedals comprise two balance pedals which are slidable along a single resistance band.

10. The physical therapy and fitness device of claim 1, wherein the one or more balance pedals remain in contact with the user's foot due at least in part to upward forces generated by the user's hands acting upwardly on the one or more bands and the one or more pedals, and not due to tying in or otherwise attaching the user's feet to the pedals.

11. The physical therapy and fitness device of claim 1, wherein the top surface of each balance pedal includes frictional grooves or pads adapted to provide a gripping action between the top surface of each balance pedal and the user's foot.

12. The physical therapy and fitness device of claim 1, wherein a bottom surface of each balance pedal includes frictional grooves or pads adapted to provide a gripping action between the bottom surface of each balance pedal and the ground.

13. The physical therapy and fitness device of claim 1, wherein a length of the one or more balance pedals is less than a length of the foot of the user of the device, thereby enabling the foot to rock back-and-forth relative to the one more balance pedals during use of the device.

14. The physical therapy and fitness device of claim 1, wherein the one or more resistance bands are color-coded to denote different lengths for seating or standing use.

15. The physical therapy and fitness device of claim 1, wherein the one or more bands are color-coded to denote differing resistances.

16. The physical therapy and fitness device of claim 1, further comprising a break in a bottom surface of the one or more balance pedals, forming a longitudinal trough, to accommodate the resistance hand, the diameter of the trough being less than the diameter of the band.

17. The physical therapy and fitness device of claim 1, wherein no break in a bottom surface of the one or more balance pedals exists.

18. The physical therapy and fitness device of claim 1, wherein the one or more balance pedals is configured to support up to about 1,000 pounds before failing.

19. The physical therapy and fitness device of claim 1, wherein the one or more balance pedals comprise acrylonitrile butadiene styrene, polycarbonate, or a blend of each.

20. The physical therapy and fitness device of claim 1, wherein each pedal has a lattice structure and is relatively lightweight, at about or less than 6 ounces each.

21. A physical therapy and fitness device, comprising:

one or more balance pedals, adapted to removably support a foot of a user during use of the device, wherein each of the one or more balance pedals includes an elongated slot running longitudinally through the balance pedal, the elongated slot receiving one or more resistance hands and the elongated slot having a width which is less than the untensioned diameter of the one or more resistance bands, to thereby permit the one or more resistance bands to be slidable through the elongated slot, wherein a top surface of the one or more balance pedals has a convex curvature in cross-section sized to accomodate the foot of the user of the device wherein during use of the device the user's foot pushes the one or more balance pedals so that the one or more balance pedals move and slide relative to the one or more resistance hands when a lateral force is exerted on the pedal by the foot of the user of the device, the one or more balance pedals thereby moving and sliding in a lateral direction generally perpendicular to a length of the foot while the user maintains resistance on the one or more resistance bands.

* * * * *